US009366149B2

(12) United States Patent
Blaney et al.

(10) Patent No.: US 9,366,149 B2
(45) Date of Patent: Jun. 14, 2016

(54) MULTI-STAGE HIGH PRESSURE COMPRESSOR CASE

(71) Applicant: United Technologies Corporation, Hartford, CT (US)

(72) Inventors: Ken F. Blaney, Middleton, NH (US); Neil L. Tatman, Brentwood, NH (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 860 days.

(21) Appl. No.: 13/623,888

(22) Filed: Sep. 21, 2012

(65) Prior Publication Data

US 2014/0083099 A1 Mar. 27, 2014

(51) Int. Cl.
*F01D 9/04* (2006.01)
*F01D 25/24* (2006.01)
*F01D 11/00* (2006.01)

(52) U.S. Cl.
CPC *F01D 9/042* (2013.01); *F01D 9/04* (2013.01); *F01D 25/24* (2013.01); *F01D 11/005* (2013.01); *Y10T 29/49826* (2015.01)

(58) Field of Classification Search
CPC .. F01D 9/042; F01D 25/246; Y10T 29/49323
See application file for complete search history.

(56) References Cited

U.S. PATENT DOCUMENTS

| | | | | |
|---|---|---|---|---|
| 2,917,276 | A | 12/1959 | Klompas et al. | |
| 4,014,627 | A | 3/1977 | Heurteux | |
| 4,083,648 | A | 4/1978 | Asplund | |
| 4,543,039 | A | 9/1985 | Ruis et al. | |
| 4,953,282 | A | 9/1990 | Corsmeier et al. | |
| 5,129,783 | A | 7/1992 | Hayton | |
| 5,299,910 | A * | 4/1994 | Gilchrist | F01D 9/042 415/189 |
| 5,462,403 | A | 10/1995 | Pannone | |
| 6,343,912 | B1 * | 2/2002 | Manteiga | F01D 11/005 415/138 |
| 6,640,437 | B2 | 11/2003 | McFarland | |
| 6,984,108 | B2 * | 1/2006 | Anderson | F01D 5/22 415/208 |
| 7,025,563 | B2 | 4/2006 | Servadio et al. | |
| 7,618,234 | B2 | 11/2009 | Brackett et al. | |
| 7,753,648 | B2 | 7/2010 | Evans et al. | |
| 2009/0110552 | A1 | 4/2009 | Anderson et al. | |
| 2012/0195746 | A1 | 8/2012 | Sarda | |

FOREIGN PATENT DOCUMENTS

GB 599391 3/1948

OTHER PUBLICATIONS

International Preliminary Report on Patentability for PCT Application No. PCT/US2013/060099 dated Apr. 2, 2015.
International Search Report and Written Opinion for PCT Application No. PCT/US2013/060099 dated Dec. 26, 2013.
Extended European Search Report for European Application No. 13839452.3, mailed on Dec. 7, 2015.

* cited by examiner

*Primary Examiner* — Troy Chambers
*Assistant Examiner* — Joshua Semick
(74) *Attorney, Agent, or Firm* — Carlson, Gaskey & Olds, P.C.

(57) ABSTRACT

A compressor case assembly according to an exemplary embodiment of this disclosure, among other possible things, includes a case. A plurality of vane stages circumscribe an interior of the case. Each of the plurality of vane stages include a vane guide and at least one window for inserting a respective at least one vane there through. The at least one window is axially aligned with each of the vane guides The at least one window extends from an outer surface of the case into each of the vane guides.

19 Claims, 3 Drawing Sheets

MULTI-STAGE HIGH PRESSURE COMPRESSOR CASE

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Generally, the compressor section includes a compressor inner case composed of multiple vane stages. Typically vane stages are connected to each other by heating one of the vane stages and applying a biasing force to the vane stage to snap fit it with an adjacent vane stage. Fasteners extending between adjacent vane stages may also be used in addition to or in place of snap fitting the vane stages together. However, heating the individual vane stages and snap fitting them together requires a significant amount of time and labor for assembly and disassembly of the compressor section.

SUMMARY

A compressor case assembly according to an exemplary embodiment of this disclosure, among other possible things, includes a case. A plurality of vane stages circumscribe an interior of the case. Each of the plurality of vane stages include a vane guide and at least one window for inserting a respective at least one vane there through. The at least one window is axially aligned with each of the vane guides The at least one window extends from an outer surface of the case into each of the vane guides.

In a further embodiment of the foregoing compressor case assembly, the case is a compressor inner case of unitary construction that includes the plurality of vane stages.

In a further embodiment of either of the foregoing compressor case assemblies, each vane guide includes a first flange along a first axial edge of the vane guide and a second flange along a second opposing axial edge of the vane guide.

In a further embodiment of any of the foregoing compressor case assemblies, the first flange and the second flange extend continuously around an inner perimeter of the case.

In a further embodiment of any of the foregoing compressor case assemblies, the first flange and the second flange are separated by a first distance and opposing axial edges of the at least one window are separated by a second distance, the second distance being greater than the first distance.

In a further embodiment of any of the foregoing compressor case assemblies, a plurality of vanes are located in each of the vane guides.

In a further embodiment of any of the foregoing compressor case assemblies, a wear strip is located in each of the vane guides that engages the plurality of vanes.

In a further embodiment of any of the foregoing compressor case assemblies, the plurality of vanes include a first vane with a first locking member and a second locking member. The first locking member on the first vane corresponds to a second locking member on a second similar vane for securing the first vane to the second vane.

In a further embodiment of any of the foregoing compressor case assemblies, the first locking member includes a projection and the second locking member includes a corresponding receptacle.

In a further embodiment of any of the foregoing compressor case assemblies, the vane guides are separated by blade outer air seals.

A gas turbine engine according to an exemplary embodiment of this disclosure, among other possible things, includes a fan including a plurality of fan blades rotatable about an axis and a compressor section including a case that includes a plurality of vane stages. Each of the vane stages include a vane guide and at least one window for inserting a respective at least one vane there through. The at least one window is axially aligned with the vane guide. The at least one window extends from an outer surface of the case into the vane guide. The engine further comprises a combustor in fluid communication with the compressor section and a turbine section in fluid communication with the combustor driving the compressor section and fan.

In a further embodiment of the foregoing gas turbine engine, the case is a compressor inner case of unitary construction that includes the plurality of vane stages.

In a further embodiment of either of the foregoing gas turbine engines, each vane guide includes a first flange along a first axial edge of the vane guide and a second flange along a second opposing axial edge of the vane guide.

In a further embodiment of any of the foregoing gas turbine engines, the first flange and the second flange extend continuously around an inner perimeter of the case.

In a further embodiment of any of the foregoing gas turbine engines, the first flange and the second flange are separated by a first distance and opposing axial edges of the at least one window are separated by a second distance, the second distance being greater than the first distance.

A method of assembling a compressor case according to an exemplary embodiment of this disclosure, among other possible things, includes inserting a first vane through a window on a case into a vane guide and indexing the first vane within the vane guide.

In a further embodiment of the foregoing method of assembling a compressor case, the method includes inserting a second vane through the window.

In a further embodiment of either of the foregoing methods of assembling a compressor case, the method includes engaging a first locking member on the first vane with a second locking member on the second vane adjacent the first vane and engaging a wear strip in the vane guides with the first vane and the second vane.

In a further embodiment of any of the foregoing methods of assembling a compressor case, the window is axially aligned with each of the vane guides and the window extends from an outer surface of the case into the vane guide.

In a further embodiment of any of the foregoing methods of assembling a compressor case, the vane guide includes a first flange and a second flange on opposing axial edges of the vane guide that extend continuously around an inner perimeter of the case. The first flange and the second flange are separated by a first distance and opposing axial edges of the window are separated by a second distance, the second distance being greater than the first distance.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
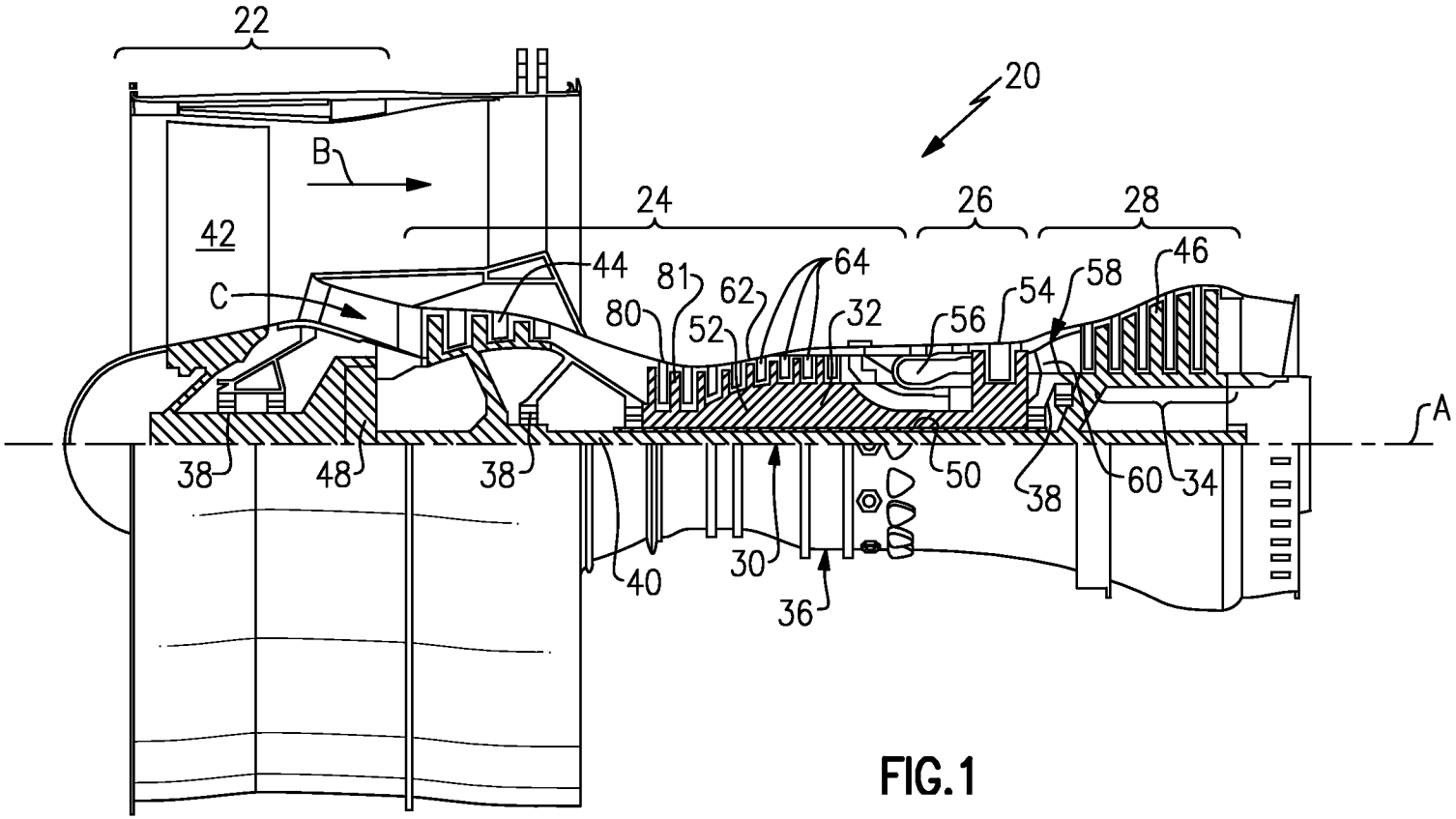
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram } °R)/(518.7\ °R)]^{0.5}$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

In this example, the high pressure compressor 52 includes an example high pressure compressor inner case 62 with multiple vane stages 64 that each include multiple high pressure compressor vanes 80. Adjacent vane stages 64 are separated by high pressure compressor rotor blades 81 located on the high speed spool 32.

Figure 2:
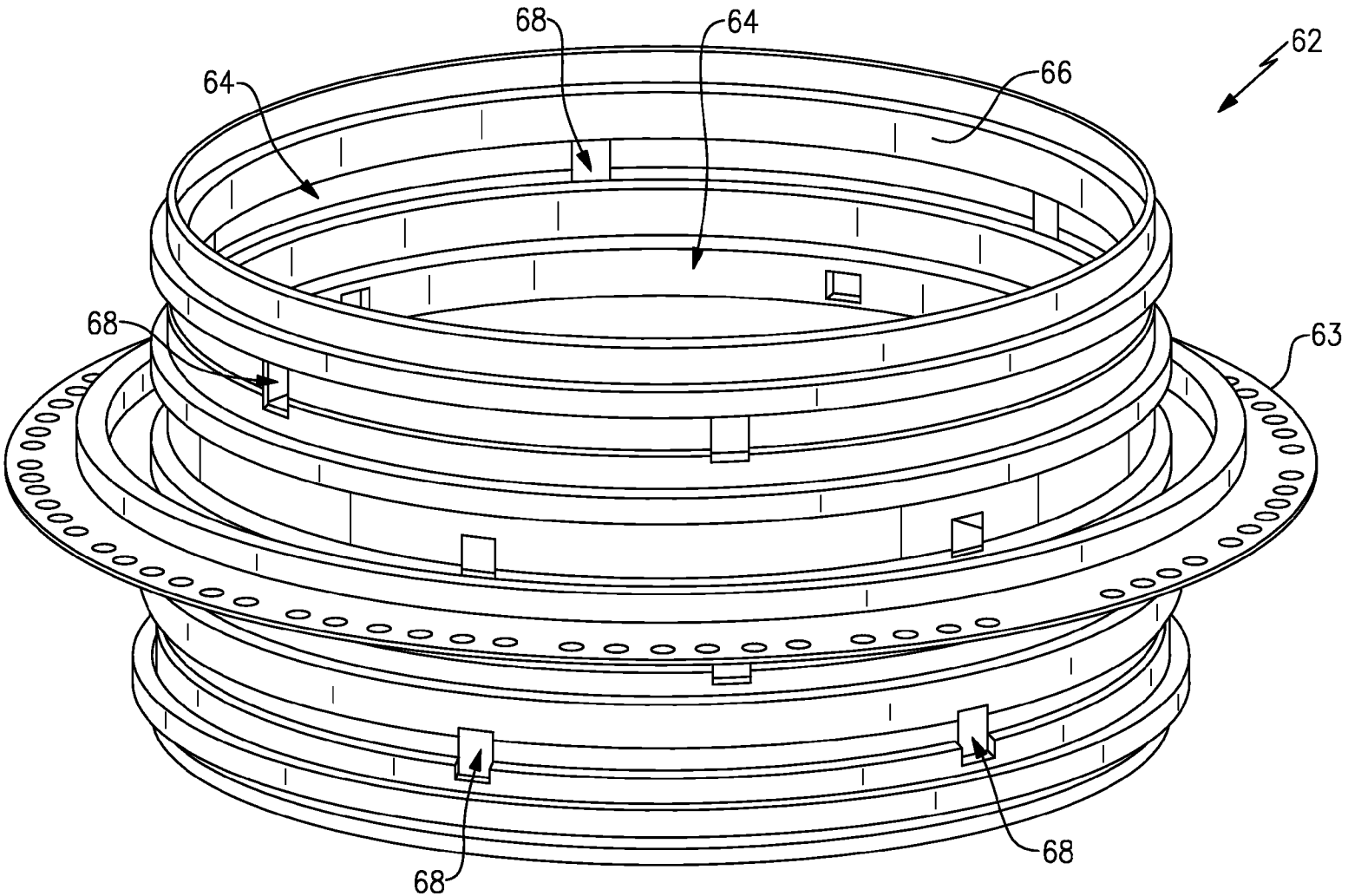
FIG. 2 is a perspective view of an example high pressure compressor inner case.
Figure 3:
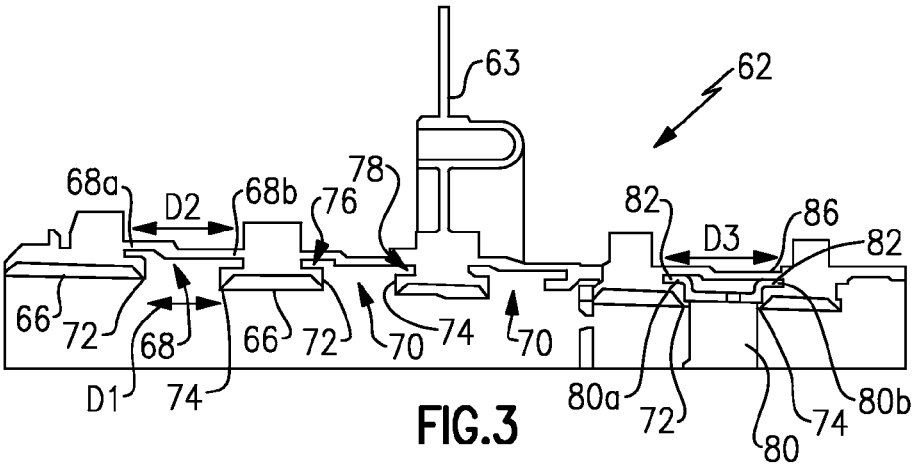
FIG. 3 is a cross-section view of the example high pressure compressor inner case.

Referring to FIGS. 2 and 3, the example high pressure compressor inner case 62 includes vane stages 64, blade outer air seals 66, and windows 68. The inner case 62 is substantially cylindrical and includes an annular flange 63 that extends around an outer circumference of the inner case 62. The inner case 62 is made of a unitary construction, with multiple vane stages 64 being located on the inner case 62 without the use of fasteners to connect adjacent vane stages 64. The vane stages 64 circumscribe an interior surface of the inner case 62. The windows 68 are axially aligned with each of the vane stages 64. In this example, each vane stage 64 includes six windows 68, however, more or less windows could be used depending on the number and size of the vanes 80. Additionally, windows 68 in this example are staggered so that windows 68 in adjacent vane stages 64 are not circumferentially aligned.

FIG. 3 illustrates a cross-sectional view of the inner case 62. Each of the vane stages 64 include a vane guide 70. A first flange 72 and a second flange 74 extend into the vane guide 70 and form a first channel 76 and a second channel 78, respectively. The first flange 72 and the second flange 74 are located on axially opposing edges of the vane guide 70. The vane 80 includes a first tab 80*a* that is accepted within the first channel 76 and a second tab 80*b* that is accepted within the second channel 78. A wear strip 82 is located within the vane guide 70 to aid in securing and removing the vanes 80 within the vane guide 70. A retainer 86 secures the vane 80 located within the window 68 to the inner case 62.

The first flange 72 and the second flange 74 are separated by a first distance D1. A first axial end 68*a* of the window 68 is spaced from a second axial end 68*b* of the window 68 by a second distance D2. The second distance D2 is greater than the first distance D1. Each vane 80 has a width D3 that is greater than the first distance D1 but less than the second distance D2 so that the vane 80 can pass through the window 68 but not between the first flange 72 and the second flange 74 during installation.

Figure 4:
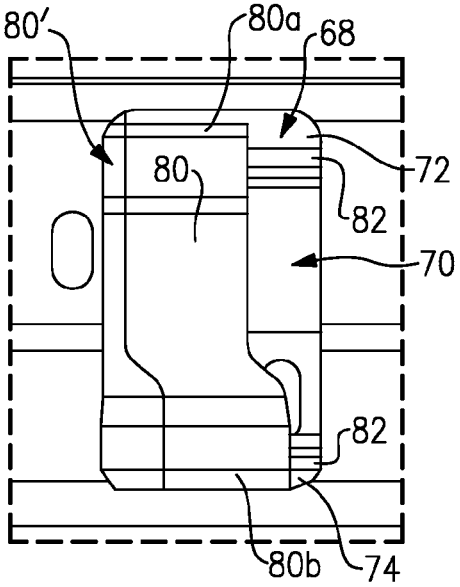
FIG. 4 is an enlarged view showing an example vane within a window on the example high pressure compressor inner case.

FIG. 4 illustrates a vane 80 inserted through the window 68 so that the first tab 80*a* of the vane 80 rests on the first flange 72 and the second tab 80*b* of the vane 80 rests on the second flange 74. Once the vane 80 is inserted through the window 68 and is in contact with the first flange 72 and the second flange 74, the vane 80 is indexed by sliding the vane 80 in a circumferential direction substantially parallel to the vane guide 70 so that the first tab 80*a* enters the first channel 76 (FIG. 3) and the second tab 80*b* enters the second channel 78 (FIG. 3). The vane 80' is slid along the first flange 72 and the second flange 74 until there is adequate clearance to insert another vane 80 into the window 68 or until all the vanes 80 are installed in the vane stage 64. As shown in FIG. 4, the vane 80' was indexed along the vane guide 70 prior to inserting the vane 80 adjacent the vane 80'. In this example, the wear strips 82 are an annular rings and are located between the vanes 80 and 80' and the inner case 62 to aid in removing the vanes 80 and 80's from the vane guide 70 during disassembly. The wear strips 82 are rotated until the vane 80 or 80' is located within the window 68 to allow for removal.

Figure 5:
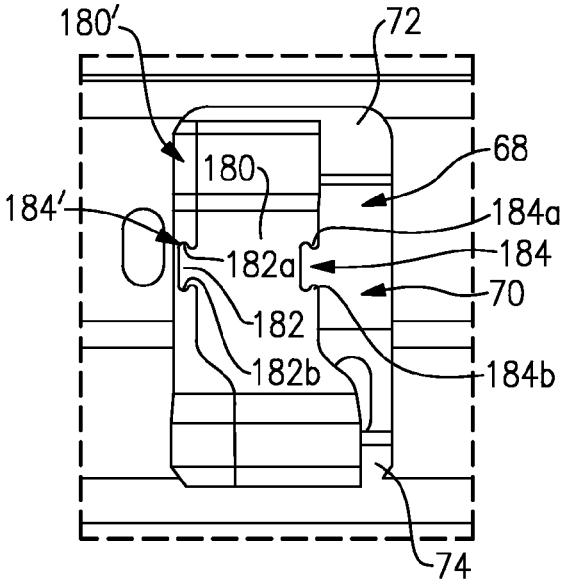
FIG. 5 is an enlarged view showing another example vane within the window on the example high pressure compressor inner case.

FIG. 5 illustrates another example vane 180 that includes an example first locking member, such as a projection 182, located along a first edge and an example second locking member, such as a receptacle 184, located on a second opposite edge of the vane 180. The projection 182 includes tapered ends 182*a* and 182*b* and the receptacle 184 includes protrusions 184*a* and 184*b*. The tapered ends 182*a* and 182*b* of the projection 182 are configured to engage protrusions 184*a'* and 184*b'* on a receptacle 184' on a similar vane 180' to connect the vanes 180 and 180' to each other. The first locking member and the second locking member aid in removing the vanes 180 or 180' during disassembly by linking the vanes 180 and 180' together so that they can slide out of the vane guide 70 together. In this example, each vane 180 includes one projection 182 and one corresponding receptacle 184, however, multiple projections 182 and receptacles 184 could be located on the vane 180 depending on the force and tools utilized to remove the vanes 180 during disassembly.

Although the disclosed example is described in reference to a high pressure compressor case, it is within the contemplation of this disclosure that it be utilized with another compressor or turbine section.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

What is claimed is:

1. A compressor case assembly comprising:

a case;

a plurality of vane stages circumscribe an interior of the case, wherein each of the plurality of vane stages include a vane guide; and at least one window for inserting a respective at least one vane there through, the at least one window being axially aligned with each of the vane guides, wherein the at least one window extends from an outer surface of the case into each of the vane guides, wherein the at least one vane includes a first interlocking feature extending from at least one of a radially inner surface or a radially outer surface of a platform and a second interlocking feature extending from at least one of the radially inner surface or the radially outer surface of the platform and the first interlocking feature includes a projection with a distal end wider than a proximal end and the second interlocking feature includes a corresponding receptacle.

2. The compressor case assembly of claim 1, wherein the case is a compressor inner case of unitary construction that includes the plurality of vane stages.

3. The compressor case assembly of claim 1, wherein each vane guide includes a first flange along a first axial edge of the vane guide and a second flange along a second opposing axial edge of the vane guide, wherein the first flange and the second flange extend continuously around an inner perimeter of the case.

4. The compressor case assembly of claim 3, wherein the first flange and the second flange are separated by a first distance and opposing axial edges of the at least one window are separated by a second distance, the second distance being greater than the first distance.

5. The compressor case assembly of claim 1, wherein the at least one vane includes a plurality of vanes located in each of the vane guides.

6. The compressor case assembly of claim 5, including a wear strip in each of the vane guides that engages the plurality of vanes.

7. The compressor case assembly of claim 1, wherein the vane guides are separated by blade outer air seals.

8. A gas turbine engine comprising:

a fan including a plurality of fan blades rotatable about an axis;

a compressor section including a case that includes a plurality of vane stages, each of the vane stages include:

a vane guide;

at least one window for inserting a respective at least one vane therethrough, the at least one window being axially aligned with the vane guide, wherein the at least one window extends from an outer surface of the case into the vane guide; and a first vane including a first interlocking feature on a first circumferential edge and a second vane including a second interlocking feature on a second circumferential edge, wherein the first interlocking feature and the second interlocking feature extend from a radially inner or radially outer surface of a platform on each of the first vane and the second vane and the first interlocking feature is located on a first circumferential edge and includes a projection with a distal end wider than a proximal end and the second interlocking feature is located on a second circumferential edge and includes a corresponding receptacle;

the engine further comprising:

a combustor in fluid communication with the compressor section; and a turbine section in fluid communication with the combustor driving the compressor section and fan.

9. The gas turbine engine of claim 8, wherein the case is a compressor inner case of unitary construction that includes the plurality of vane stages.

10. The gas turbine engine of claim 8, wherein each vane guide includes a first flange along a first axial edge of the vane guide and a second flange along a second opposing axial edge of the vane guide and the first flange and the second flange are separated by a first distance and opposing axial edges of the at least one window are separated by a second distance, the second distance being greater than the first distance.

11. The gas turbine engine of claim 10, wherein the first flange and the second flange extend continuously around an inner perimeter of the case.

12. A method of assembling a compressor case:

inserting a first vane having a first interlocking feature through a window on a case into a vane guide;

indexing the first vane within the vane guide; and directing a second vane having a second interlocking feature radially inward to engage the first interlocking feature on the first vane.

13. The method of claim 12, including inserting a second vane through the window.

14. The method as recited in claim 13, including engaging a wear strip in the vane guides with the first vane and the second vane.

15. The method as recited in claim 12, wherein the window is axially aligned with each of the vane guides and the window extends from an outer surface of the case into the vane guide.

16. The method of claim 12, wherein the vane guide includes a first flange and a second flange on opposing axial edges of the vane guide that extend continuously around an inner perimeter of the case, the first flange and the second flange being separated by a first distance and opposing axial edges of the window are separated by a second distance, the second distance being greater than the first distance.

17. The method of claim 12, wherein directing the second vane having the second interlocking feature radially inward to engage the first interlocking feature on the first vane includes aligning a first circumferential edge on the first vane with a second circumferential edge on the second vane, the first interlocking feature is located on the first circumferential edge and the second interlocking feature is located on the second circumferential edge.

18. The compressor case assembly of claim 1, wherein the first interlocking feature extends from the radially inner surface to a radially outer surface of the platform and the second interlocking feature extends from the radially inner surface to the radially outer surface of the platform.

19. The compressor case assembly of claim 1, wherein the first interlocking feature is located on a first circumferential edge and the second interlocking feature is located on a second circumferential edge opposite the first circumferential edge.

* * * * *